United States Patent [19]

Scheffler et al.

[11] 4,297,304

[45] Oct. 27, 1981

[54] METHOD FOR SOLIDIFYING AQUEOUS RADIOACTIVE WASTES FOR NON-CONTAMINATING STORAGE

[75] Inventors: Knut Scheffler, Eggenstein-Leopoldshafen; Ulrich Riege, Linkenheim-Hochstetten, both of Fed. Rep. of Germany

[73] Assignee: Kernforschungszentrum Karlsruhe, GmbH, Karlsruhe, Fed. Rep. of Germany

[21] Appl. No.: 914,152

[22] Filed: Jun. 9, 1978

[30] Foreign Application Priority Data

Jun. 10, 1977 [DE] Fed. Rep. of Germany ..... 2726087

[51] Int. Cl.[3] ..... G21C 21/00

[52] U.S. Cl. ..... 264/0.5; 252/629; 264/60; 264/63; 264/333

[58] Field of Search ..... 252/301.1 W; 264/63, 264/60, 66, 82, 81, 131, 134, 333, 320, 332, 340, 338, 0.5

[56] References Cited

U.S. PATENT DOCUMENTS

| | | | |
|---|---|---|---|
| 3,249,551 | 5/1966 | Bixby | 252/301.1 W |
| 3,849,330 | 11/1974 | Isaacson | 252/301.1 W |
| 4,056,482 | 11/1977 | Schmieder et al. | 252/301.1 W |
| 4,115,311 | 9/1978 | Sump | 252/301.1 W |
| 4,119,561 | 10/1978 | Drobnik et al. | 252/301.1 W |
| 4,122,028 | 10/1978 | Iffland et al. | 252/301.1 W |

*Primary Examiner*—John Parrish

*Attorney, Agent, or Firm*—Spencer & Kaye

[57] ABSTRACT

Method for solidifying high and medium radioactivity and/or actinide containing aqueous waste concentrates or fine-grained solid wastes suspended in water for final noncontaminating storage. The waste concentrates or suspensions are set, by evaporation, to a water content in the range between 40 and 80 percent by weight, and a solid content whose metal ion and/or metal oxide component lies between 10 and 30 percent by weight of the evaporate being formed. The pH of the evaporate is set to between 5 and 10. The evaporate is kneaded with a clay-like substance containing a small quantity of cement or such a clay-like substance or mixture of a clay-like substance with a small quantity of cement containing an additive for suppressing the volatility of the alkalis or alkali earths and/or an additive for suppressing the volatility of any decomposing anions which may be present in the evaporate from the group including sulfate, phosphate, molybdate and uranate ions. The kneading occurs at a weight ratio range of evaporate to clay-like substance of 1:1 to 2:1. Molded bodies are produced from the resulting kneaded mass. The molded bodies are then heat treated including drying at temperatures between room temperature and about 150° C., calcining at temperatures up to about 800° C. and subsequently firing at temperatures between 800° C. and 1400° C. to form practically undissolvable mineral phases. The molded bodies of fired mineral phases are enclosed on all sides in a dense, continuous ceramic or metallic matrix.

24 Claims, No Drawings

METHOD FOR SOLIDIFYING AQUEOUS RADIOACTIVE WASTES FOR NON-CONTAMINATING STORAGE

BACKGROUND OF THE INVENTION

The present invention relates to a method for solidifying high and medium radioactivity and/or actinide containing aqueous waste concentrates or fine-grained solid wastes suspended in water for final noncontaminating storage in which the waste concentrates or the suspensions are subjected, together with absorbing and/or hydraulically binding inorganic materials, to a ceramic firing process so as to produce a solid sintered body.

It has been known for a long time to solidify radioactive aqueous solutions by first reducing the volume of such wastes, thereby concentrating the radioactive substances, and then treating the concentrates either by (1) subjecting them together with glass formers to a heat treatment until the radioactive substances become distributed throughout the resulting glass melt and then having the melt solidify into a solid body, or (2) by mixing the concentrated wastes with silicate-containing clays or with ion exchangers, respectively, and firing the resulting mix ceramically so as to form a solid body.

Some of the drawbacks of producing glass blocks having radioactive waste substances incorporated therein include the need to use relatively complicated and expensive apparatus which must be operated by trained personnel. Moreover, in the course of prolonged storage, decomposition of the glass structure may occur due to the continued emission of radiation and heat energy by the incorporated highly radioactive substances with the result that the resistance of the glass structure to leaching deteriorates with time and its ability to effectively retain radioactive materials is diminished, especially as compared to the relatively good leaching properties of nondecomposed glass waste blocks.

When clay-radionuclide mixtures are fired according to the prior art, the quality of the solidified products containing high concentrations of radioactive substances has not been sufficient for final storage purposes.

An additional problem encountered with prior art solidification by glass and fired clay processes is that during the high temperature stages, significant quantities of radioactive substances evaporate from the not yet solidified waste. These escaping impurities must be trapped and removed by complicated waste gas purification techniques involving solids filters, gas washing columns and condensate separators.

German Pat. No. 1,127,508 to Alberti proposes mixing aqueous atomic waste with fireproof cement and then increasing the density of the resulting hardened block by ceramic firing to produce a sintered body which is resistant to leaching. In order to increase the mechanical stability of the hardened block, the patent suggests adding fireproof additives such as fire clay or brick chips to the fireproof cement. For example, a cylindrical molded body was produced from molten alumina cement and radioactive liquid. The molded body, after hardening, was uniformly heated for a period of 5 hours to a temperature of 500° C. to evaporate excess water. The molded body was then rapidly brought to a firing temperature of, for example, 1100° C. and kept at this temperature for about 2 to 4 hours after which the molded body was cooled slowly. No information is given in the patent about the radioactivity of the radioactive liquid being treated. There is also no disclosure in the patent as to the quantities of liquid being treated in the 3-liter vessels used by Alberti or as to the water-cement values, or the like. Results of leaching experiments likewise were not disclosed.

The Alberti process may be useful for the solidification of low radioactivity aqueous wastes, but it is very expensive and unnecessarily complicated. Further, it cannot be used for the solidification of high or medium radioactivity and/or actinide containing aqueous wastes.

Medium activity waste solutions have been solidified in cement, concrete or bitumen at temperatures of more than about 150° C. Solidification of medium activity waste solutions with cement, concrete or bitumen leads to end products which have low thermal stability and relatively low radiation resistance over extended periods of time. As a result, special safety measures become necessary when depositing these products for intermediate or final storage.

When seeking to store actinide concentrates, the intensive development of radiolysis gases and heat in the product, as a result of the radioactive decomposition of the actinides, renders bitumen, cement or concrete solidification processes completely unsuitable.

Suspended combustion ashes or ion exchangers have previously been solidified in cement and put into barrels which act as sheaths. The thus sheathed, solidified products have then been put directly into storage. The properties of such blocks, however, particularly with respect to mechanical stability and leaching resistance, are not particularly good, so that this type of solidification is used only for weakly active wastes.

SUMMARY OF THE INVENTION

It is therefore a primary object of the present invention to provide a method for solidifying high and medium radioactivity aqueous wastes as well as actinide containing aqueous wastes and/or suspended powdery solid wastes, in which the solidification products do not exhibit the drawbacks of the prior art fixing processes and which meet all requirements for final storability.

It is a further object of the invention to provide a process for preparing radioactive wastes for storage in which the wastes are securely stored and not easily leached.

It is yet another object of the invention to provide a process which is simple and uncomplicated but effective in preventing radioactive contamination.

An additional object of the invention is to provide a process for producing a solidified product which is not troubled by emissions of radiolysis gases.

To achieve the foregoing objects and in accordance with its purposes, the present invention provides a method for solidifying high and medium radioactivity and/or actinide containing aqueous waste concentrates or fine-grained solid wastes suspended in water for final noncontaminating storage in which the waste concentrates or the suspensions are subjected together with absorbing and/or hydraulically binding inorganic material, to a ceramic firing process so as to produce a solid sintered body, comprising (a) setting the waste concentrates or suspensions by evaporation to form an evaporate (B) having a water content in the range between 40 and 80 percent by weight and a solid content whose metal ion and/or metal oxide component lies between 10 and 30 percent by weight of the evaporate (B) being formed, and setting the pH of the evaporate (B) to between 5 and 10; (b) kneading the evaporate (B) obtained from step (a) with a clay-like substance containing a small quantity of cement or such a clay-like substance or mixture of clay-like substance with a small quantity of cement containing an additive for suppressing the volatility of alkalis, esp. cesium or alkali earths, esp. strontium and/or an additive for suppressing the volatility of any decomposing anions which may be present in the evaporate from the group including sulfate, phosphate, molybdate and uranate ions, at a weight ratio range of evaporate (B) to clay-like substance of 1:1 to 2:1; (c) producing molded bodies from the kneaded mass obtained from step (b); (d) heat treating the molded bodies, including drying at temperatures between room temperature and about 150° C., calcining at temperatures up to about 800° C. and subsequently firing at temperatures between about 800° C. and 1400° C. to practically undissolvable mineral phases; and (e) enclosing the molded bodies of fired mineral phases on all sides in a dense, continuous ceramic or metallic matrix.

DETAILED DESCRIPTION OF THE INVENTION

According to the present invention, a liquid which may, for example, be either a suspension or solution of radioactive waste materials is prepared for noncontaminating final storage. The waste materials treated according to the present invention are the by-products of manufacturing, processing and reprocessing of nuclear fuels as well as the wastes of nuclear plants and the like.

The wastes treated according to the present invention may be categorized and defined as follows:

(1) High activity waste solutions—these comprise nitric acid solutions containing predominantly heavy metal nitrates, which are produced during the separation of fission products from spent nuclear fuels.

(2) Medium activity waste solutions—these are predominantly nitric acid solutions, generally containing a large amount of sodium nitrate, which are obtained during reprocessing of nuclear fuels and during decontamination processes in nuclear plants.

(3) Actinide concentrates—these are solutions or powders or combustion residues, which are obtained mainly as waste products during the processing and manufacture of nuclear fuels.

(4) Ashes and residues from the combustion of organic radioactive wastes—these ashes and residues are fine-grained solid wastes and are suspended in water.

In the process of the present invention, the waste concentrates or suspensions being treated are set by evaporation to a water content in the range between 40 and 80 percent by weight and a solid content whose metal ion and/or metal oxide component lies between 10 and 30 percent by weight of the evaporate (B) being formed. In addition, the pH of the evaporate (B) is set to between 5 and 10.

The pH of the evaporate is set such that it is between about 5 and 10. The setting may, for example, be made by the addition of highly alkaline solutions or by denitration of nitrate containing wastes, by known means such as by adding formic acid or formaldehyde. The setting of the pH of the evaporate can be effected either by treating the waste concentrates or suspensions before the evaporation or by treating the evaporate. Concentration to produce evaporate (B) by evaporation, which may take place before and/or after adjustment of the pH, can be effected until a barely flowable concentrate is obtained.

The concentrated radioactive evaporate having the desired pH is then transferred into a mixer or kneader where it is stirred and homogenized with the addition of a dry mixture of additives, which mainly include clay-like materials to form a stiff dough. The mixture of the additives comprises a main component and preferably an ancillary component. Main components include kaolin, clay, alumina and/or quartz meal, with cement being an ancillary component.

The mixing ratio of substances contained in the radioactive concentrate and the additive mixture should preferably be selected such that shape-retaining bodies can be produced from the doughy mass which has a water content of about 50 percent by weight. Additionally, the ratio of substances selected should be such that the resulting molded bodies, after drying and sintering, have a chemical composition which corresponds to that of natural, stable minerals or rocks.

The mixture of the additives may contain 7 to 20 percent by weight cement with reference to the clay-like material plus the cement. By adding cement, there is obtained a molded body which, after complete hardening, maintains its shape even when treated with water. This advantage is utilized in such a manner that water soluble salts which have come to the surface of the molded body during the subsequent drying (hardening) process can be removed by rinsing with water. The wash water can then be returned to the radioactive solution at the start of the process. A further advantage resulting from the addition of cement is the added mechanical and structural stability which it imparts to the molded bodies during subsequent process steps.

The kneaded doughy product is then converted into molded bodies by either pressing the dough into molds or by extruding them, for example, by means of an extrusion press. When shaped by molding, the dough is kept in the mold only until it can easily be removed after shrinking.

In an advantageous embodiment of the method of the present invention, the kneading of the evaporate is effected with a mixture of about 10 parts by weight clay-like substance and about 1 to 2 parts by weight of a cement which contains about 20 to 30 weight percent $SiO_2$ and about 40 to 70 weight percent CaO.

The clay-like substance advantageously contains $SiO_2$ in the range from 45 to 70 percent by weight and $Al_2O_3$ in the range from 15 to 40 percent by weight and has a loss due to heating in the range from 5 to 15 percent by weight. The clay-like substance may be one or more species selected from the group of pottery clays, stoneware clays, porcelain clay mixtures and kaolins.

In an alternate embodiment of the present invention, instead of or together with adding cement to the clay-like substance, the clay-like substance is provided with one or more additives to suppress or limit the volatility of certain components. The additive for suppressing the alkali, esp. cesium, and alkali earth, esp. strontium volatility can comprise 1 to 3 parts per weight $TiO_2$ powder compared to 20 parts per weight of clay-like material, or 1 to 5 weight percent $TiO_2$, with respect to the kneaded mass. The additive for suppressing sulfate, molybdate and uranate volatility comprises about 1 to 5 percent by weight BaO while the additive for suppressing phosphate volatility comprises about 2 to 10 percent by weight MgO or BeO or ground, natural beryllium, each weight percentage being with reference to the kneaded mass. A given evaporate does not necessarily contain each ion from the group sulfate, phosphate, molybdate and uranate ions, and thus an additive need be provided only for the ions present in the evaporate.

After making the molded bodies from the kneaded mass, but before heat treatment, the molded bodies are allowed to harden and may be surface decontaminated with water.

The molded bodies are advantageously dried and hardened in a stream of air at room temperature which requires a period of time for cement containing products of up to 30 days until they are completely hardened. The completely hardened molded bodies can then be washed with water to remove water soluble salts from their surfaces. Thereafter, the molded bodies are subjected to the heat treatment which includes further drying the molded bodies in a drying furnace at higher temperatures so that any nitrates contained therein are thermally decomposed. The heating sequence for this heat treatment is largely dependent on the chemical composition of the molded bodies and their dimensions. Several hours are generally required at temperatures ranging from room temperature to about 150° C. to expel chemically unbound water. At the calcining temperatures ranging from about 150° C. to about 800° C., chemically bound water is expelled and the thermal decomposition of metal nitrates into metal oxides and nitrous gases takes place. The thermal decomposition temperatures of nitrates which are present in higher concentrations must be given particular consideration and it is, therefore, necessary to control the heating rate taking the characteristic decomposition temperatures of each of the nitrates into account. This may necessitate slowing up the heating in a particular temperature range or maintaining it at a given temperature for a period of time until the exhaust air stream contains no significant moisture and no nitrous gases. Thus, the heating is in effect carried out in stages with the heating being stopped or slowed at the decomposition temperatures of the nitrate compounds present as well as at the temperatures at which the water may be removed. Control and regulation of the heating program is effected simply by continuous quantitative measurement of the amount of condensate collected from the furnace exhaust gases in a condensate separator and by a continuous quantitative measurement of the concentration of nitrous gases in the furnace exhaust gas.

The furnace exhaust gases preferably can be purified in a washing column with dilute nitric acid so as to absorb nitrous gases. These washing solutions, as well as the condensates from the condenser connected upstream of the washing column, are evaporated in an evaporator. The resulting distillates are treated further as weakly active waste solutions and are not part of the process of the present invention. The concentrates from this evaporator can be introduced as waste materials at the start of the process.

After reaching the final temperature of about 800° C. in the drying furnace, the molded bodies are sintered in a sintering furnace to produce the desired end product. Instead of a separate drying furnace and a separate sintering furnace, drying and sintering can take place in the same furnace. The sintering process is performed at temperatures between about 800° C. and about 1400° C. preferably between 1100° C. and 1400° C., to form bodies having practically undissolvable mineral phases and results in significant shrinkage of the molded bodies. Therefore, in order to prevent the formation of cracks and cavities in the end product, care must be taken, depending on the size of the molded bodies, that the sintering process be performed at a sufficiently slow rate. The optimum sintering temperature and time must be adapted to the respective product composition.

The monolithic sintered bodies are then inserted into metal containers. Because of the heat given off as a result of radioactive decay, the air space between the sintered body and the metal vessel can be filled by encasing the sintered bodies in a dense continuous matrix having a higher heat conductivity than the bodies themselves, such as cement or low melting point metals or alloys such as lead, bronzes and the like. The metal container itself will then be the final storage container for the radioactive wastes that are solidified in the ceramic.

In one embodiment of the present invention, the sintered bodies are comminuted and the comminuted, sintered bodies are enclosed in the continuous matrix. In this instance, the bodies are preferably comminuted to particles or chips between about 1 mm. and 10 mm. in size.

The continuous matrix completely encloses the molded body or chips and preferably can be made of either cement rock, produced from at least one kind of cement from the group comprising portland cement, iron portland cement, shaft furnace cement, trass cement, oil shale cement and alumina cement in weight ratios of clay-like material to cement ranging from about 10:1 to 4:1. To further improve heat conductance, the continuous matrix may comprise a copper-zinc alloy, a copper-tin alloy, lead or a lead alloy having a lead content of more than about 50 percent by weight. In cases where the continuous matrix is not made of a metal or an alloy, respectively, ceramic firing, possibly with simultaneous use of pressure, terminates the densification of the matrix waste mixture.

Compared to the prior art processes for solidifying high activity waste solutions, such as, for example solidification in a glass matrix, etc., the process according to the present invention has a number of distinct advantages. For example, in the process of the present invention, primary solidification takes place at room temperature, so that during the subsequent drying and sintering processes activity can escape only through the surface of the solidified products so that the solidified products themselves act as filters during these high temperature treatments.

Further, whereas the known methods require complicated apparatus and procedural devices with remote control in hot cells or alpha-tight cells, the process according to the present invention uses very simple devices which are adapted very easily to the operating conditions for handling radioactive substances.

The process according to the present invention has the further advantage that the troublesome corrosion problems normally encountered during the melting of glass are avoided. The products produced according to the process of the present invention are stable up to temperatures of more than 1000° C. and, due to their particular chemical nature, do not develop radiolysis gases. Thus, it is also possible to solidify high concentrations of actinides in the ceramic matrix since adverse effects on the properties of the end product, which are relevant for final storage, which might otherwise result from the development of radiolysis gases as a result of alpha radiation or high storage temperatures are eliminated.

Yet another advantage of the process according to the present invention is its easy adaptability to changes in the chemical and physical consistency and composition of the radioactive wastes.

The invention will now be explained by way of the examples which follow without, however, being limited to these examples.

EXAMPLE 1

The chemical composition of a highly active nitric acid waste solution which is obtained during reprocessing of spent fuel elements in a light water nuclear reactor where 33,000 MWd/t fuel are burnt was simulated in its main components by chemically similar inactive isotopes. The nitric acid waste solution was denitrated with formic acid such that a pH of 2.5 resulted. The pH of the solution was then adjusted by the addition of 1 M sodium liquor, to a value of 6 and was concentrated by way of distillation. After this pretreatment, the solution or suspension, respectively, had the following chemical composition:

| | | |
|---|---|---|
| (a) | water content: | 700 g $H_2O$ |
| (b) | residual nitrate content: | 109 g $NO_3^-$ |
| (c) | residue after heating: | |
| | 91.2 g $Gd_2O_3$ | |
| | 35.0 g $ZrO_2$ | |
| | 36.5 g $MoO_3$ | |
| | 23.4 g $Na_2O$ | |
| | 18.8 g BaO | |
| | 28.5 g Ag | |
| | 8.0 g $MnO_2$ | |
| | 4.0 g Te | |
| | 12.8 g $Pb_3O_4$ | |
| | 20.8 g $Fe_3O_4$ | |
| | 3.7 g $Cr_2O_3$ | |
| | g NiO | |
| | 285.9 g Total | |

This solution or suspension, respectively was kneaded in a kneading vessel together with 981 grams of a mixture of portland cement and Hirschau kaolin (weight ratio 1:8) to form a dough. By pressing the doughy mixture through a tube, molded bodies were produced having a diameter of 25 mm and a height of about 20 mm. Further, cylindrical bodies having a diameter of 80 mm and a height of 80 mm were shaped from the doughy mixture in polyethylene beakers. These latter bodies could be removed from the beakers after only 3 days due to shrinkage of the mass. All of the molded bodies were dried in air for 20 to 30 days then rinsed with water and thereafter dried, calcined and sintered in a furnace at increasing temperatures. The heating schedule for the furnace is shown in the table below.

| Temperature (°C.) | Time (Hours) |
|---|---|
| 20–150 | 15 |
| 150–800 | 30 |
| 800–1150 | 5 |
| 1150–1280 | 10 |

The sintered end product exhibited an elevated hardness of 6 to 7 according to the Mohs scale, and poor solubility in water. The water solubility at room temperature is less than $10^{-6}$ g of the product with reference to 1 $cm^2$ of surface per day.

The table below gives the chemical composition of the product.

| Components | Weight - % |
|---|---|
| $SiO_2$ | 38.8 |
| $Al_2O_3$ | 26.8 |
| CaO | 6.2 |
| $Fe_3O_4$ | 0.9 |
| $TiO_2$ | 0.3 |
| MgO | 0.7 |
| $Na_2O$ | 0.1 |
| $K_2O$ | 1.9 |
| Fission product oxides (See heat treatment residue (c)) | 24.3 |

The stoichiometry of this sintered body end product corresponds approximately to that of anorthite or nepheline, respectively, which are known as very stable natural minerals.

EXAMPLE 2

Medium activity waste solutions which are the result of the reprocessing of nuclear fuels contain up to 90% sodium nitrate as salt ballast. To simulate this category of waste, a sodium nitrate solution was made into a dough with a cement/kaolin mixture (weight ratio of 1:10). The chemical compositions of the dough was as follows:

| | |
|---|---|
| simulated waste solution: | 184 g $NaNO_3$ |
| | 300 g Water |
| portland cement: | 50 g |
| Geisenheim kaolin | 500 g |

As in Example 1, molded bodies were again produced by extruding and molding. Air drying and rinsing with water were effected as in Example 1. The heating schedule for the drying, calcination and sintering steps is given in the table below:

| Temperature (°C.) | Time (Hours) |
|---|---|
| 20–150 | 12 |
| 150–400 | 20 |
| 400–450 | 25 |
| 450–800 | 15 |
| 800–1150 | 10 |
| 1150–1200 | 10 |

The sintered end product has a hardness of 5 to 6 on the Mohs scale. The water solubility at room temperature is about $10^{-6}$ g of the product with reference to 1 $cm^2$ of surface per day. The chemical composition of the sintered end product is shown in the table below:

| Component | Weight - % |
|---|---|
| $SiO_2$ | 45.8 |
| $Al_2O_3$ | 31.9 |
| CaO | 5.9 |
| $Fe_2O_3$ | 1.0 |
| $TiO_2$ | 0.4 |
| MgO | 0.4 |
| $K_2O$ | 2.3 |
| $Na_2O$ (From sodium | |

-continued

| Component | Weight - % |
|---|---|
| nitrate solution) | 12.3 |

The stoichiometry of this sintered body end product corresponds approximately to that of nepheline which is known as a very stable natural mineral.

EXAMPLE 3

Actinide concentrates which are formed as radioactive wastes during the manufacture of plutonium containing fuel elements are either evaporated solutions or combustion ashes obtained from the combustion of organic materials. They contain as radioactive components relatively large quantities of plutonium and americium which is produced during the radioactive decay of the relatively short-lived plutonium isotope $Pu^{241}$. These actinide concentrates can be easily bound into a ceramic matrix according to the present invention since the chemical nature of the waste components themselves comes close to the heat treatment residues of the high activity waste solutions listed in Example 1. To simulate this category of waste, a suspension of 2.94 g americium dioxide powder in 7 g water was mixed into a dough with a mixture of 10 g portland cement and Hirschau kaolin (weight ratio 1:10).

The doughy mass was pressed through a polyethylene tube so that a cylindrical molded body resulted which had a diameter of 20 mm and a height of 30 mm. The molded body was dried for 10 days at room temperature. In the same manner, a molded body was produced from 7 g of water and 10 g of a mixture of portland cement and Hirschau kaolin, (weight ratio 1:10) but without americium dioxide and likewise dried for 10 days at room temperature. Both molded bodies exhibited the same shrinkage of 28±2% after drying compared to the starting volume during manufacture. This proves that radiolysis gas development and decomposition heat are without influence on the manufacturing process.

The molded body containing $AmO_2$ was dried in a furnace at increasing temperatures and sintered according to the heating program below:

| Temperature (°C.) | Time (Hours) |
|---|---|
| 20–150 | 8 |
| 150–800 | 24 |
| 800–1150 | 10 |
| 1150–1300 | 10 |

After sintering, a product resulted having a stoichiometry corresponding to anorthite or nepheline. The weight loss of the sintered product during leaching with water at room temperature is less than $10^{-7}$ g per $cm^2$ surface. per day. The chemical composition of the sintered product is shown in the table below:

| Component | Weight - % |
|---|---|
| $SiO_2$ | 39.2 |
| $Al_2O_3$ | 27.3 |
| CaO | 5.0 |
| $Fe_2O_3$ | 0.8 |
| $TiO_2$ | 0.3 |
| MgO | 0.4 |
| $Na_2O$ | 0.1 |

-continued

| Component | Weight - % |
|---|---|
| $K_2O$ | 1.9 |
| $AmO_2$ | 25.0 |

The specific alpha activity of the sintered body is 715 mCi/g, the specific decay heat is about 22 mW/g.

EXAMPLE 4

In addition to dry combustion with oxygen from the air, the organic radioactive wastes from the production of plutonium containing fuel elements can also be concentrated by wet combustion methods. One of these methods is based on the carbonization of organic wastes in concentrated sulfuric acid at temperatures above 200° C. and subsequent oxidation of the carbon with chemical oxidation means such as nitric acid. This produces combustion residues having high sulfate contents which, mainly after neutralization with sodium liquor, contain large amounts of sodium sulfate but also sodium chloride from the combustion of polyvinyl chloride.

In Example 2 it was shown that sodium nitrate solutions can be solidified into a sintered body to form a chemical compound which stoichiometrically corresponds to the natural mineral nepheline. It is, moreover, possible to solidify sodium sulfate and sodium chloride containing sodium nitrate solutions in the same manner where the absorption capability of nepheline for sodium sulfate is limited to 14 percent by weight and for sodium chloride to 12 percent by weight. The crystallic phases formed thereby correspond to the natural stable minerals noselite which contains sodium sulfate and sodalite which contains sodium chloride.

EXAMPLE 5

100 ml of a solution containing 5 weight-% sodium sulfate were mixed with 180 g of kaolin with and without addition of 4 weight-% BaO with respect to the kneaded mass and solidified to a sintered body. It was qualitatively demonstrated by condensing the foam evolved upon sintering that the BaO-containing sample had a very low release of sulfate with respect to the reference sample.

EXAMPLE 6

100 ml of a solution containing 10 weight-% cesium nitrate were kneaded with 200 g of kaolin. To half of this batch, 10 g of $TiO_2$-powder were additionally added. Both samples were solidified to sintered bodies in the same manner. The foam evolved during the sintering process was condensed and analyzed for its cesium content. The $TiO_2$ containing product had a cesium volatility of less than two orders of magnitude lower than the reference sample.

It will be understood that the above description of the present invention is susceptible to various modifications, changes and adaptations, and the same are intended to be comprehended within the meaning and range of equivalents of the appended claims.

What is claimed is:

1. Method for solidifying high radioactivity aqueous waste concentrates, medium radioactivity aqueous waste concentrates, actinide containing aqueous waste concentrates, or suspensions of fine-grained solid wastes suspended in water, which concentrates or suspensions contain a metal ion and/or metal oxide, for final non-contaminating storage in which the waste concentrates or the suspensions are subjected together with an absorbing and/or hydraulically binding inorganic material, to a ceramic firing process so as to produce a solid sintered body, comprising the steps of:

(a) treating the waste concentrates or suspensions by evaporation, to form an evaporate, to a water content in the range between 40 and 80 percent by weight and a solid content whose metal ion and/or metal oxide concentration lies between 10 and 30 percent by weight of the evaporate being formed, and adjusting the pH of the evaporate to between 5 and 10;

(b) kneading the evaporate obtained from step (a) with a clay-like substance containing a small quantity of cement or mixture of a clay-like substance with a small quantity of cement containing an additive for suppressing the volatility of alkali metals or alkaline earth metals which may be present in the evaporate and/or an additive for suppressing the volatility of any decomposable anions which may be present in the evaporate selected from the group consisting of sulfate, phosphate, molybdate and uranate ions, at a weight ratio range of evaporate to clay-like substance of 1:1 to 2:1, said clay-like substance being at least one substance selected from the group consisting of pottery clays, stoneware clays, porcelain clay mixtures and kaolins;

(c) producing molded bodies from the kneaded mass obtained from step (b);

(d) heat treating the molded bodies, including drying at temperatures between room temperature and 150° C., calcining at temperatures of about 150° to 800° C., and subsequently firing at temperatures between 800° and 1400° C. to form practically undissolvable mineral phases having a chemical composition corresponding approximately to that of natural, stable minerals or rocks; and (e) enclosing the molded bodies containing the fired mineral phases on all sides in a dense, continuous ceramic or metallic matrix.

2. The method as defined in claim 1, in which the molded bodies of step (d) are comminuted to a grain size range of about 1 to 10 mm before being enclosed in the matrix of step (e).

3. The method as defined in claim 1 wherein the kneading of step (b) is effected with a mixture of 10 parts by weight of a clay-like substance and 1 to 2 parts by weight of a cement containing 20 to 30 weight percent $SiO_2$ and 40 to 70 weight percent CaO, and said molded bodies of step (c) are allowed to harden, and are subsequently surface decontaminated with water before step (d).

4. The method as defined in claim 1 wherein said clay-like substance contains $SiO_2$ in a range from about 45 to 70 percent by weight and $Al_2O_3$ in a range from about 15 to 40 percent by weight and has a loss due to heating which lies in the range from about 5 to 15 percent by weight.

5. The method as defined in claim 1 wherein the additive for suppressing the volatility of the alkali metals and alkaline earth metals comprises about 1 to 3 parts by weight $TiO_2$ powder compared to 20 parts by weight clay-like substance.

6. The method as defined in claim 1 wherein the additive for suppressing the volatility of the alkali metals and alkaline earth metals comprises about 1 to 5 weight percent $TiO_2$ with respect to the kneaded mass obtained from process step (b).

7. The method as defined in claim 1 wherein the additive for suppressing the volatility of sulfate, molybdate and/or uranate comprises 1 to 5 weight percent BaO with respect to the kneaded mass obtained from step (b).

8. The method as defined in claim 1 wherein the additive for suppressing the volatility of phosphate comprises about 2 to 10 weight percent MgO with respect to the kneaded mass obtained from step (b).

9. The method as defined in claim 1 wherein the additive for suppressing the volatility of phosphate comprises about 2 to 10 weight percent BeO or ground natural beryllium with respect to the kneaded mass of step (b).

10. The method as defined in claim 1 wherein the continuous matrix comprises at least one cement selected from the group consisting of portland cement, iron portland cement, shaft furnace cement, trass cement, oil shale cement, alumina cement and mixtures thereof.

11. The method as defined in claim 1 wherein the continuous matrix comprises a fired ceramic produced from (1) at least one clay-like substance selected from the group consisting of pottery clays, stoneware clays, porcelain clay mixtures, and kaolin and (2) at least one cement selected from the group consisting of portland cement, iron portland cement, shaft furnace cement, trass cement, oil shale cement, and alumina cement in a weight ratio range of clay-like substance to cement of 10:1 to 4:1.

12. The method as defined in claim 1 wherein the continuous matrix is made of a copper-zinc alloy.

13. The method as defined in claim 1 wherein the continuous matrix is made of a copper-tin alloy.

14. The method as defined in claim 1 wherein the continuous matrix is made of lead or a lead alloy having a lead content of more than 50 percent by weight.

15. The method as defined in claim 1 wherein the adjusting of the pH is effected by the addition of a strongly alkali solution.

16. The method as defined in claim 1 which comprises adjusting the pH of said evaporate by denitrating.

17. The method as defined in claim 16 wherein the denitrating is effected with formaldehyde.

18. The method as defined in claim 1 which comprises adjusting the pH of the evaporate by denitrating with formic acid.

19. The method as defined in claim 1 which further comprises measuring the water and $NO_x$ content of gases given off during the drying and calcining stages of step (d) and varying the time and temperature of the drying and calcining stages as a function of the measured water and $NO_x$ content.

20. Method for solidifying high radioactivity aqueous waste concentrates, medium radioactivity aqueous waste concentrates, actinide containing aqueous waste concentrates, or suspensions of fine-grained solid wastes suspended in water, which concentrates or suspensions contain a metal ion and/or metal oxide, for final non-contaminating storage in which the waste concentrates or the suspensions are subjected together with an absorbing and/or hydraulically binding inorganic material, to a ceramic firing process so as to produce a solid sintered body, comprising the steps of:

(a) treating the waste concentrates or suspensions by evaporation, to form an evaporate, to a water content in a range between 40 and 80 percent by weight and a solid content whose metal ion and/or metal oxide concentration lies between 10 and 30 percent by weight of the evaporate being formed, and adjusting the pH of the evaporate to between 5 and 10;

(b) kneading the evaporate obtained from step (a) with a clay-like substance containing an additive for suppressing the volatility of alkali metals or alkaline earth metals which may be present in the evaporate and/or an additive for suppressing the volatility of any decomposable anions which may be present in the evaporate selected from the group consisting of sulfate, phosphate, molybdate and uranate ions, at a weight ratio range of evaporate to clay-like substance of 1:1 to 2:1, said clay-like substance being at least one substance selected from the group consisting of pottery clays, stoneware clays, porcelain clay mixtures and kaolins;

(c) producing molded bodies from the kneaded mass obtained from step (b);

(d) heat treating the molded bodies, including drying at temperatures between room temperatures and 150° C., calcining at temperatures of about 150° to 180° C., and subsequently firing at temperatures between 800° and 1400° C. to form practically undissolvable mineral phases having a chemical composition corresponding approximately to that of natural, stable minerals or rocks; and (e) enclosing the molded bodies containing the fired mineral phases on all sides in a dense, continuous ceramic or metallic matrix.

21. The method as defined in claim 1, wherein said natural, stable mineral is nepheline.

22. The method as defined in claim 1, wherein said natural, stable mineral is anorthite.

23. The method as defined in claim 1, wherein said natural, stable mineral is noselite.

24. The method as defined in claim 1, wherein said natural, stable mineral is sodalite.

* * * * *